US009882293B1

(12) United States Patent
Chen

(10) Patent No.: US 9,882,293 B1
(45) Date of Patent: Jan. 30, 2018

(54) CABLE CONNECTOR WITH TWO SETS OF CLAMPING PLATES FOR APPLYING CLAMPING FORCE AND REDUCING IMPACT OF IMPEDANCE DISCONTINUITY

(71) Applicant: SIMULA TECHNOLOGY INC., Taoyuan (TW)

(72) Inventor: Shih-Jui Chen, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 15/599,509

(22) Filed: May 19, 2017

(30) Foreign Application Priority Data

Nov. 22, 2016 (TW) ..... 105138264 A

(51) Int. Cl.

| | |
|---|---|
| ***H01R 4/36*** | (2006.01) |
| ***H01R 9/05*** | (2006.01) |
| ***H01R 13/621*** | (2006.01) |
| ***H01R 13/58*** | (2006.01) |
| *H01R 24/44* | (2011.01) |
| *H01R 4/28* | (2006.01) |

(52) U.S. Cl.
CPC ..... *H01R 9/0524* (2013.01); *H01R 13/582* (2013.01); *H01R 13/5812* (2013.01); *H01R 13/621* (2013.01); *H01R 4/28* (2013.01); *H01R 24/44* (2013.01)

(58) Field of Classification Search
CPC ..... H01R 9/0524; H01R 9/05; H01R 9/032; H01R 13/5812; H01R 13/621; H01R 13/582; H01R 9/0518; H01R 13/62
See application file for complete search history.

(56) References Cited

U.S. PATENT DOCUMENTS

| | | | | |
|---|---|---|---|---|
| 6,302,732 | B1 * | 10/2001 | Budman | H01R 9/0515 439/581 |
| 6,872,089 | B1 * | 3/2005 | Chen | H01R 4/2433 439/417 |
| 8,137,134 | B1 * | 3/2012 | Chang | H01R 9/0518 439/582 |
| 2006/0094297 | A1 * | 5/2006 | Wang | H01R 4/16 439/578 |
| 2014/0191457 | A1 * | 7/2014 | Sharma | H05K 3/301 269/37 |

* cited by examiner

*Primary Examiner* — Thanh T Nguyen
(74) *Attorney, Agent, or Firm* — Bacon & Thomas, PLLC

(57) ABSTRACT

A cable connector with two sets of clamping plates for applying a clamping force and reducing the impact of impedance discontinuity includes an insulating base, a housing, a signal terminal, and two ground terminals. The insulating base has a top portion concavely provided with a receiving space. The housing is mounted on the insulating base and has a through hole corresponding to the receiving space. The signal terminal and the ground terminals are set separately in a bottom portion of the insulating base, have top portions respectively configured for clamping a coaxial cable extending into the receiving space, and have bottom portions soldered respectively to a signal contact and a ground contact on a circuit board. One of the ground terminals is adjacent to the signal terminal to reduce the impact of impedance discontinuity. The other ground terminal applies an additional clamping force to the coaxial cable.

7 Claims, 4 Drawing Sheets

CABLE CONNECTOR WITH TWO SETS OF CLAMPING PLATES FOR APPLYING CLAMPING FORCE AND REDUCING IMPACT OF IMPEDANCE DISCONTINUITY

FIELD OF THE INVENTION

The present invention relates to a cable connector that has two sets of clamping plates configured not only for applying a clamping force, but also for reducing the impact of impedance discontinuity. More particularly, the invention relates to a cable connector with a signal terminal and two ground terminals that integrate both performance and durability considerations into the connector structure, with the two sets of terminals clamping a coaxial cable separately, wherein one of the ground terminals is adjacent to the signal terminal to reduce the negative impact of impedance discontinuity while the other ground terminal is away from the signal terminal and provides an additional clamping force.

BACKGROUND OF THE INVENTION

Connectors for signal and/or power transmission refer generally to connecting devices designed for use with electronic signals and/or electric power, and their accessories. These connectors can be viewed as bridges for all kinds of signals, and their quality affects the stability of signal and/or current transmission and is crucial to the operation of electronic systems. With the advancement of electronic technology, such connectors have had different specifications and developed into various models that vary in their fields of application, physical dimensions, and methods of use, in addition to the types of the signals to be transmitted. For all the specifications and models, however, "transmission stability" and "durability" have always been two major factors that cannot be overlooked in connector design.

Take a "cable connector" for connecting with a coaxial cable for example. A coaxial cable typically has a central conductor, either single-core (e.g., a single bare copper wire) or multicore (e.g., a twisted pair of copper wires, a copper-clad steel wire, or a tin-plated copper wire), surrounded sequentially by layers of tubular materials. More specifically, the conductor is surrounded by an insulation layer; the insulation layer, by a copper braid shield (generally made of a mesh of copper, aluminum, or other metal wires); and the copper braid shield, by a jacket (made of an insulating plastic material). Having a concentric cross section, coaxial cables are structured to shield the electromagnetic signals transmitted therethrough from the interference of external noise and are therefore often used to transmit high-frequency signals such as video and network signals.

Generally speaking, referring to FIG. 1, a cable connector uses its signal terminal 11 and ground terminal 12 to clamp a coaxial cable 10 (please note that the housing and other irrelevant components of the cable connector are not shown in FIG. 1). More particularly, the signal terminal 11 clamps one end of the coaxial cable 10 and cuts through the exposed insulation layer 101 in order to be electrically connected to the conductor inside. The ground terminal 12, on the other hand, cuts through the jacket 102 of the coaxial cable 10 and is electrically connected to the copper braid shield. Ideally, signal transmission through the coaxial cable 10 generates an evenly distributed electromagnetic field that fluctuates only when the cable is extended to an interface whose impedance is different from that of the cable. In other words, the electromagnetic field is changed only at the junctures between the coaxial cable 10, the signal terminal 11 (or the ground terminal 12), and the circuit board 13 due to the differences in impedance between the aforesaid components. This change in electromagnetic field nevertheless causes unstable signal transmission. To minimize the negative impact of such a mismatch in impedance, the distance 110 between the signal terminal 11 and the ground terminal 12 should be as short as possible.

However, with the copper braid shield of the coaxial cable 10 having relatively low structural strength, reducing the distance 110 between the signal terminal 11 and the ground terminal 12 requires that the ground terminal 12 clamp the copper braid shield at a position adjacent to the edge of the copper braid shield, thus compromising the clamping strength between the ground terminal 12 and the copper braid shield; that is to say, when the coaxial cable 10 is pulled, the copper braid shield is very likely to be torn, and the coaxial cable 10 may get loose as a result.

But if the distance 110 between the signal terminal 11 and the ground terminal 12 is increased to enable the ground terminal 12 to clamp the main body (i.e., the portion with a denser structure than the edge) of the copper braid shield, the electromagnetic field generated by signal transmission will reflect between the signal terminal 11 and the ground terminal 12, thereby aggravating the negative impact of the mismatch, or discontinuity, of impedance. A cable connector designer, therefore, must decide between "transmission stability" (i.e., to shorten the distance 110 between the signal terminal 11 and the ground terminal 12) and "durability" (i.e., to increase the distance 110 between the signal terminal 11 and the ground terminal 12) and cannot achieve both. The issue to be addressed by the present invention is to resolve the dilemma by improving the structure of the conventional cable connectors.

BRIEF SUMMARY OF THE INVENTION

In light of the fact that the distance between the signal terminal and the ground terminal of a conventional cable connector is associated with not only "the magnitude of the force with which to clamp a coaxial cable" but also "the negative impact of discontinuity of impedance" and creates a dilemma in design, the inventor of the present invention put years of practical experience into extensive research and repeated trials and finally succeeded in developing a cable connector with two sets of clamping plates for applying a clamping force and reducing the impact of impedance discontinuity so as to effectively overcome the drawback of the prior art.

It is an objective of the present invention to provide a cable connector having two sets of clamping plates for reducing the impact of impedance discontinuity as well as applying a clamping force. The cable connector includes an insulating base, a housing, a signal terminal, a first ground terminal, and a second ground terminal. The insulating base has a top portion concavely provided with a downwardly extending receiving space. The receiving space is in communication with the front and rear ends of the insulating base. The bottom side of the insulating base is formed with a first assembly groove, a second assembly groove, and a third assembly groove. The assembly grooves are arranged at intervals and are in communication with the receiving space. The housing has a bottom portion concavely provided with an upwardly extending recess. The housing is also provided with a through hole at one end. When the housing and the insulating base are in the assembled state, the insulating base is engaged in the recess such that the through hole corresponds to the receiving space. The configurations of the through hole and of the receiving space match that of a coaxial cable, wherein the coaxial cable includes, from the inside out, a conductor, an insulation layer, a copper braid shield, and a jacket. One end of the coaxial cable extends through the through hole into the receiving space such that a portion of the jacket that is adjacent to that end of the coaxial cable is pressed against the wall of the through hole. The signal terminal is set in the first assembly groove such that a top portion of the signal terminal is exposed in the receiving space while a bottom portion of the signal terminal extends out of the insulating base and is soldered to a signal contact on a circuit board. The top portion of the signal terminal is provided with a clamping notch. Once the coaxial cable is properly inserted into the receiving space, a portion of the conductor that is at the aforesaid end of the coaxial cable is engaged in the clamping notch and thereby electrically connected to the signal terminal. The first ground terminal is set in the second assembly groove such that a top portion of the first ground terminal is exposed in the receiving space while a bottom portion of the first ground terminal extends out of the insulating base and is soldered to a ground contact on the circuit board. The top portion of the first ground terminal is extended with two first clamping plates. The first clamping plates define a first clamping distance therebetween. The first clamping distance is smaller than or equal to the outer diameter of the copper braid shield of the coaxial cable in order for the first clamping plates to clamp a portion of the copper braid shield that is adjacent to the aforesaid end of the coaxial cable. The first clamping plates and the signal terminal define a first distance therebetween. The second ground terminal is set in the third assembly groove such that a top portion of the second ground terminal is exposed in the receiving space while a bottom portion of the second ground terminal extends out of the insulating base and is soldered to the ground contact on the circuit board. The top portion of the second ground terminal is extended with two second clamping plates. The second clamping plates define a second clamping distance therebetween. The second clamping distance is also smaller than or equal to the outer diameter of the copper braid shield of the coaxial cable in order for the second clamping plates to clamp the copper braid shield. The second clamping plates and the first clamping plates define a second distance therebetween. The second distance is greater than the first distance. According to the above, the first ground terminal is adjacent to the signal terminal to shorten the span of impedance discontinuity, and the second ground terminal applies an additional clamping force to ensure that the coaxial cable is secured in position.

BRIEF DESCRIPTION OF THE SEVERAL VIEWS OF THE DRAWINGS

The technical features, design principle, and objectives of the present invention can be better understood by referring to the following detailed description of some illustrative embodiments in conjunction with the accompanying drawings, in which.

DETAILED DESCRIPTION OF THE INVENTION

Figure 1:
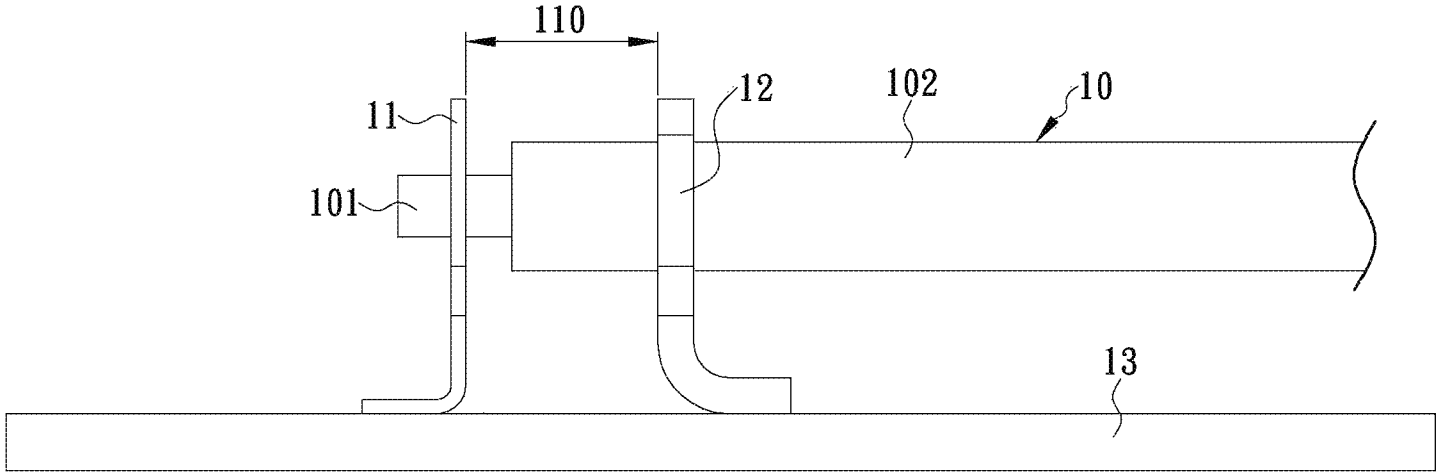
FIG. 1(Prior Art)
FIG. 1 schematically shows the terminals of a conventional cable connector and a coaxial cable.
Figure 2:
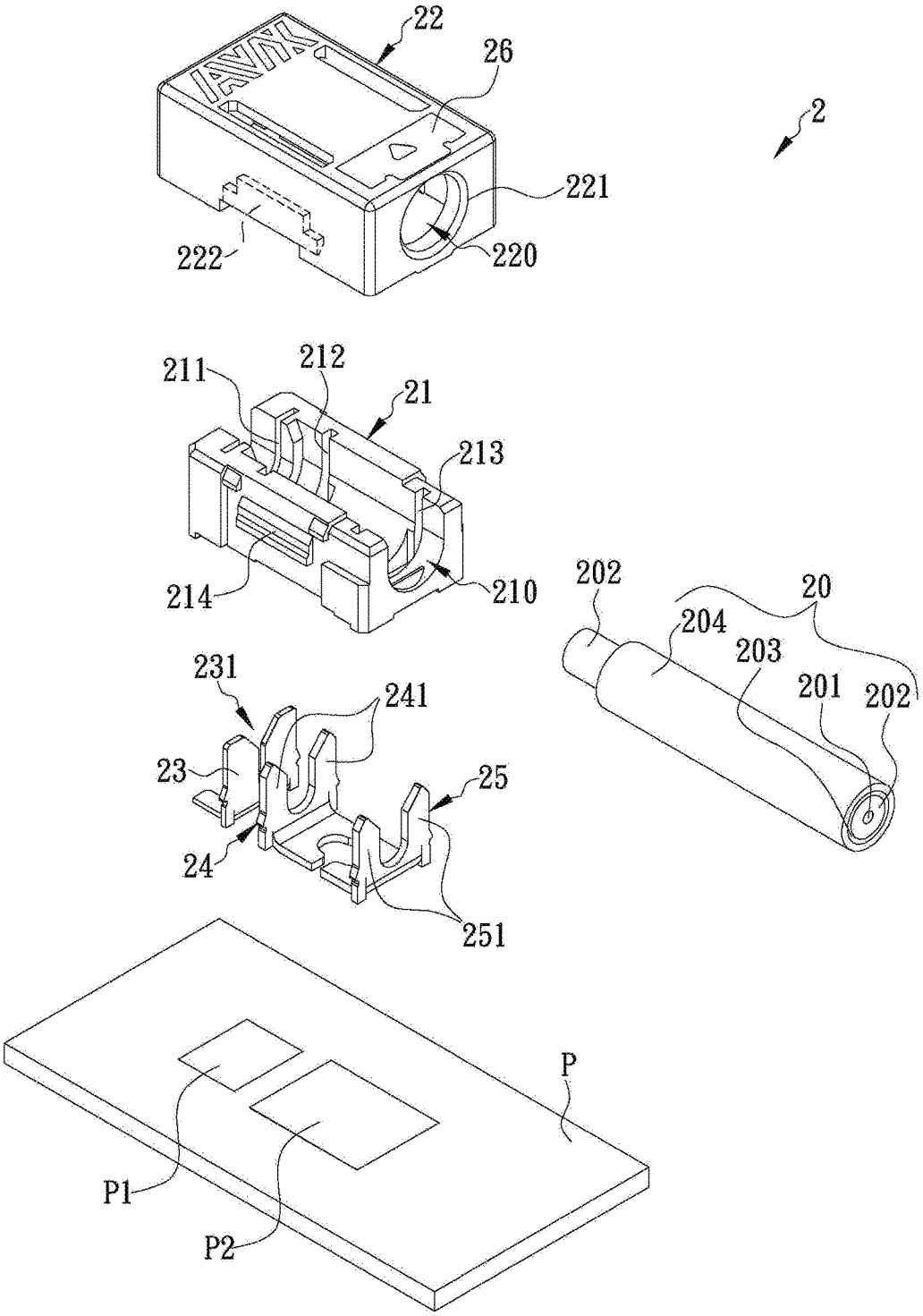
FIG. 2 is an exploded perspective view of the cable connector in the first preferred embodiment of the present invention.

The present invention provides a cable connector having two sets of clamping plates for not only applying a clamping force but also reducing the impact of impedance discontinuity. Referring to FIG. 2 for the first preferred embodiment of the invention, the cable connector 2 is configured for connecting a circuit board P to a coaxial cable 20. The coaxial cable 20 includes, from the inside out, a conductor 201, an insulation layer 202, a copper braid shield 203, and a jacket 204, wherein the insulation layer 202 is exposed at one end of the coaxial cable 20. To facilitate description, the upper left corner of FIG. 2 is defined as the rear side of the cable connector 2, and the lower right corner of FIG. 2, as the front side of the cable connector 2.

Figure 3:
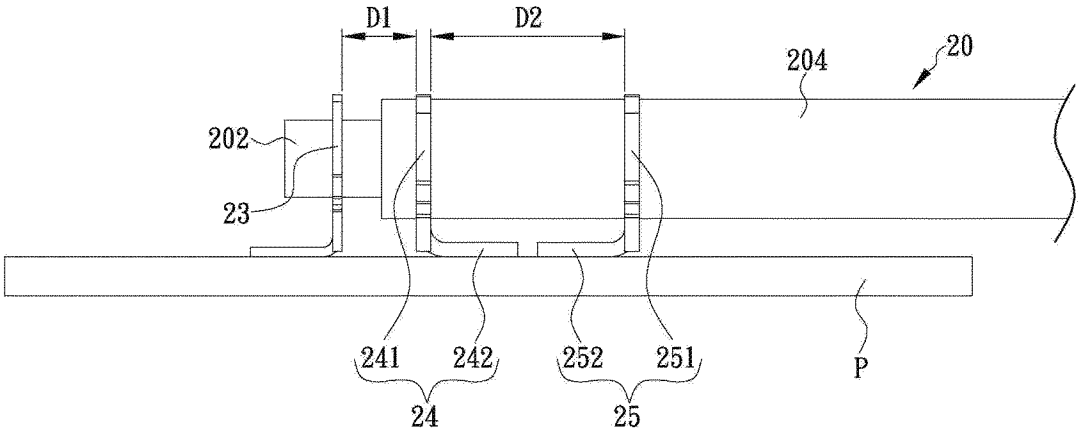
FIG. 3 schematically shows the terminals of the cable connector in FIG. 2 and a coaxial cable.

As shown in FIGS. 2 and 3, the cable connector 2 includes an insulating base 21, a housing 22, a signal terminal 23, a first ground terminal 24, and a second ground terminal 25. The insulating base 21 has a top portion concavely provided with a downwardly extending receiving space 210. The receiving space 210 is in communication with the front and rear ends of the insulating base 21. The bottom side of the insulating base 21 is formed with a first assembly groove 211, a second assembly groove 212, and a third assembly groove 213. The assembly grooves 211~213 are arranged at intervals and are in communication with the receiving space 210.

The housing 22 has a bottom portion concavely provided with an upwardly extending recess 220. A through hole 221 is provided at one end of the housing 22 (i.e., the front end of the cable connector 2). When the housing 22 and the insulating base 21 are in the assembled state, the insulating base 21 is engaged in the recess 220, with the through hole 221 corresponding to the receiving space 210. The configurations of the through hole 221 and of the receiving space 210 match the configuration of the coaxial cable 20. The aforesaid end of the coaxial cable 20 extends into the receiving space 210 through the through hole 221 such that a portion of the jacket 204 that is adjacent to the end of the coaxial cable 20 is pressed against the wall of the through hole 221.

The signal terminal 23 is set in the first assembly groove 211, with a top portion of the signal terminal 23 exposed in the receiving space 210 and a bottom portion of the signal terminal 23 extending out of the insulating base 21 and soldered to a signal contact P1 on the circuit board P. The top portion of the signal terminal 23 is provided with a clamping notch 231. Once the coaxial cable 20 is properly inserted into the receiving space 210, a portion of the conductor 201 that is at the aforesaid end of the coaxial cable 20 is engaged in the clamping notch 231 and thus electrically connected to the signal terminal 23.

The first ground terminal 24 is set in the second assembly groove 212, with a top portion of the first ground terminal 24 exposed in the receiving space 210 and a bottom portion of the first ground terminal 24 extending out of the insulating base 21 and soldered to a ground contact P2 on the circuit board P. The top portion of the first ground terminal 24 is extended with two first clamping plates 241. The first clamping plates 241 define a first clamping distance therebetween, wherein the first clamping distance is smaller than or equal to the outer diameter of the copper braid shield 203 of the coaxial cable 20 so that a portion of the copper braid shield 203 that is adjacent to the exposed portion of the conductor 201 can be clamped between the first clamping plates 241. The first clamping plates 241 and the signal terminal 23 define a first distance D1 therebetween.

The second ground terminal 25 is set in the third assembly groove 213, with a top portion of the second ground terminal 25 exposed in the receiving space 210 and a bottom portion of the second ground terminal 25 extending out of the insulating base 21 and soldered to the ground contact P2 on the circuit board P. The top portion of the second ground terminal 25 is extended with two second clamping plates 251. The second clamping plates 251 define a second clamping distance therebetween. The second clamping distance is also smaller than or equal to the outer diameter of the copper braid shield 203 of the coaxial cable 20 so that the copper braid shield 203 can be clamped between the second clamping plates 251. The second clamping plates 251 and the first clamping plates 241 define a second distance D2 therebetween, and the second distance D2 is greater than the first distance D1.

As the bottom portions of the first ground terminal 24 and of the second ground terminal 25 are soldered to the same ground contact P2 on the circuit board P, the distance between "the signal terminal" and "the ground terminals as a whole", i.e., the two parts resulting in discontinuity of impedance with reference to the coaxial cable 20 or the circuit board P, is the first distance D1 between the first ground terminal 24 and the signal terminal 23 (or the distance between the signal contact P1 and the ground contact P2), and the span of impedance discontinuity is thus minimized to ensure stability of signal transmission. Moreover, with the bottom portions of the first ground terminal 24 and of the second ground terminal 25 soldered to the same ground contact P2 on the circuit board P, the provision of the second ground terminal 25 does not cause repeated reflection of electromagnetic waves between the signal terminal 23 and the second ground terminal 25, meaning the second ground terminal 25 has no further impedance-related negative impact. Rather, the second ground terminal 25, which corresponds in position to the main body of the coaxial cable 20, clamps a relatively dense portion of the copper braid shield 203 of the coaxial cable 20 and thus provides a secure clamping force.

According to the above, the two ground terminals 24 and 25 are so configured that they clamp different parts of the coaxial cable 20 respectively and are soldered at the bottom to the same ground contact P2 such that the difficulty of designing the ground terminal position as typically encountered in the prior art is easily and effectively overcome. Furthermore, to downsize the cable connector 2 and the circuit board P, the ratio of the second distance D2 to the first distance D1 in this embodiment is 2~3:1.

With continued reference to FIG. 2 and FIG. 3, the ground terminals 24 and 25 are L-shaped; the bottom portion of the first ground terminal 24 is provided with a first solder plate 242, which extends toward the second ground terminal 25; and the bottom portion of the second ground terminal 25 is provided with a second solder plate 252, which extends toward the first ground terminal 24.

The cable connector 2 and the coaxial cable 20 are put together in the following manner. To begin with, the housing 22 is positioned on the insulating base 21. The left and right sides of the insulating base 21 are each protrudingly provided with a first engaging portion 214, and the housing 22 is provided with two second engaging portions 222 corresponding to the wall of the recess 220. The bottom ends of the second engaging portions 222 are pressed respectively against the top ends of the first engaging portions 214 when the housing 22 is positioned on the insulating base 21. The insulating base 21 in this state is only partially engaged in the recess 220, allowing an assembler to put the coaxial cable 20 into the recess 220 through the through hole 221.

Then, the housing 22 is pushed down so that the second engaging portions 222 are deformed and move past the top ends of the first engaging portions 214 into engagement with the first engaging portions 214 respectively. The insulating base 21 is now completely engaged in the recess 220, and the signal terminal 23 has cut through the insulation layer 202 of the coaxial cable 20 and is electrically connected to the conductor 201. Also, the ground terminals 24 and 25 have cut through the jacket 204 of the coaxial cable 20 and are electrically connected to the copper braid shield 203.

In this embodiment, the cable connector 2 further includes a reinforcing element 26. The reinforcing element 26 is a metal plate embedded in the housing 22 at a position adjacent to the through hole 221 (e.g., the housing 22 is injection-molded to incorporate the reinforcement element 26). The reinforcing element 26 serves to increase the structural strength of the housing 22 so that the housing 22 can resist a greater pulling force than without the reinforcing element 26 and will not break easily when the coaxial cable 20 is pulled.

Figure 4:
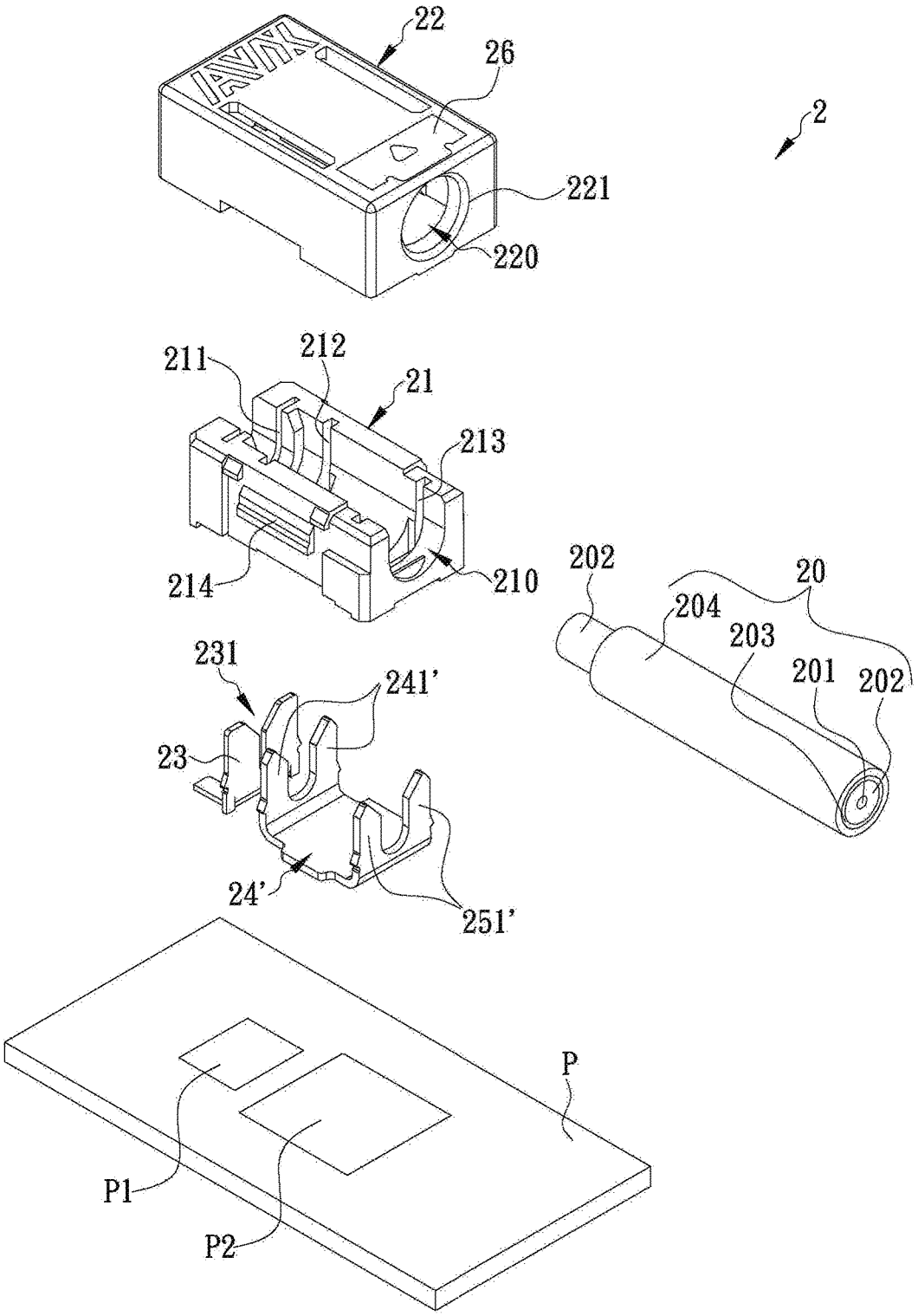
FIG. 4 is an exploded perspective view of the cable connector in the second preferred embodiment of the present invention.

In this embodiment, the two ground terminals 24 and 25 achieve "reducing the negative impact of impedance discontinuity" and "providing a strong clamping force" respectively. To further increase the clamping strength, the ground terminals 24 and 25 may alternatively be connected to form a single unit, or more than two ground terminals may be provided (and must be soldered to the same ground contact). Referring to FIG. 4 for the second preferred embodiment of the present invention, the cable connector 2 only has one ground terminal 24', which is set in a bottom portion of the insulating base 21 and has a top portion extended with two first clamping plates 241' and two second clamping plates 251'. The first clamping plates 241' and the second clamping plates 251' extend through the second assembly groove 212 and the third assembly groove 213 respectively to be exposed in the receiving space 210. A bottom portion of the ground terminal 24' extends out of the insulating base 21 and is soldered to a ground contact P2 on the circuit board P.

The first clamping plates 241' define a clamping distance therebetween, and so do the second clamping plates 251'. The clamping distances are smaller than or equal to the outer diameter of the copper braid shield 203 of the coaxial cable 20 so that, once the coaxial cable 20 extends into the receiving space 210, the first clamping plates 241' can cut through the jacket 204 to clamp a portion of the copper braid shield 203 that is adjacent to the aforesaid end of the coaxial cable 20 and the second clamping plates 251' can also cut through the jacket 204 to clamp the copper braid shield 203. The first clamping plates 241' and the signal terminal 23 define a first distance therebetween, and the second clamping plates 251' and the first clamping plates 241' define a second distance therebetween. The second distance is greater than the first distance. As the first clamping plates 241' and the second clamping plates 251' are both soldered to the ground contact P2 on the circuit board P via the bottom portion of the ground terminal 24', the two sets of clamping plates 241' and 251' are capable of "reducing the negative impact of impedance discontinuity" and "providing a strong clamping force" respectively, just as their counterparts in the first preferred embodiment.

The embodiment described above is but a preferred one of the present invention and does not impose limitation on the technical features of the invention. All equivalent changes based on the technical contents disclosed herein and readily conceivable by a person of ordinary skill in the art should fall within the scope of the present invention.

What is claimed is:

1. A cable connector with two sets of clamping plates for applying a clamping force and reducing an impact of impedance discontinuity, comprising:

an insulating base having a top portion concavely provided with a downwardly extending receiving space; the receiving space being in communication with a front end and a rear end of the insulating base; the insulating base having a bottom side formed with a first assembly groove, a second assembly groove, and a third assembly groove; the assembly grooves being arranged at intervals and in communication with the receiving space;

a housing having a bottom portion concavely provided with an upwardly extending recess, the housing having an end provided with a through hole, wherein when the housing and the insulating base are in an assembled state, the insulating base is engaged in the recess such that the through hole corresponds to the receiving space; each of the through hole and the receiving space has a configuration matching a configuration of a coaxial cable; the coaxial cable comprises, from inside out, a conductor, an insulation layer, a copper braid shield, and a jacket; and the coaxial cable has an end extending through the through hole into the receiving space such that a portion of the jacket that is adjacent to the end of the coaxial cable is pressed against a wall of the through hole;

a signal terminal set in the first assembly groove such that a top portion of the signal terminal is exposed in the receiving space while a bottom portion of the signal terminal extends out of the insulating base and is soldered to a signal contact on a circuit board; the top portion of the signal terminal being provided with a clamping notch such that, once the coaxial cable is properly inserted into the receiving space, a portion of the conductor that is at the end of the coaxial cable is engaged in the clamping notch and is electrically connected to the signal terminal;

a first ground terminal set in the second assembly groove such that a top portion of the first ground terminal is exposed in the receiving space while a bottom portion of the first ground terminal extends out of the insulating base and is soldered to a ground contact on the circuit board; the top portion of the first ground terminal being extended with two first clamping plates, wherein the first clamping plates define a first clamping distance therebetween, the first clamping distance is smaller than or equal to an outer diameter of the copper braid shield of the coaxial cable in order for the first clamping plates to clamp a portion of the copper braid shield that is adjacent to the end of the coaxial cable, and the first clamping plates and the signal terminal define a first distance therebetween; and a second ground terminal set in the third assembly groove such that a top portion of the second ground terminal is exposed in the receiving space while a bottom portion of the second ground terminal extends out of the insulating base and is soldered to the ground contact on the circuit board; the top portion of the second ground terminal being extended with two second clamping plates, wherein the second clamping plates define a second clamping distance therebetween, the second clamping distance is also smaller than or equal to the outer diameter of the copper braid shield of the coaxial cable in order for the second clamping plates to clamp the copper braid shield, the second clamping plates and the first clamping plates define a second distance therebetween, and the second distance is greater than the first distance.

2. The cable connector of claim 1, wherein the second distance and the first distance are in a ratio of 2~3:1.

3. The cable connector of claim 2, wherein the bottom portion of the first ground terminal is provided with a first solder plate extending toward the second ground terminal, and the bottom portion of the second ground terminal is provided with a second solder plate extending toward the first ground terminal.

4. The cable connector of claim 3, wherein the cable connector further comprises a reinforcing element embedded in the housing at a position adjacent to the through hole.

5. A cable connector with two sets of clamping plates for applying a clamping force and reducing an impact of impedance discontinuity, comprising:

an insulating base having a top portion concavely provided with a downwardly extending receiving space; the receiving space being in communication with a front end and a rear end of the insulating base; the insulating base having a bottom side formed with a first assembly groove, a second assembly groove, and a third assembly groove; the assembly grooves being arranged at intervals and in communication with the receiving space;

a housing having a bottom portion concavely provided with an upwardly extending recess, the housing having an end provided with a through hole, wherein when the housing and the insulating base are in an assembled state, the insulating base is engaged in the recess such that the through hole corresponds to the receiving space; each of the through hole and the receiving space has a configuration matching a configuration of a coaxial cable; the coaxial cable comprises, from inside out, a conductor, an insulation layer, a copper braid shield, and a jacket; and the coaxial cable has an end extending through the through hole into the receiving space such that a portion of the jacket that is adjacent to the end of the coaxial cable is pressed against a wall of the through hole;

a signal terminal set in the first assembly groove such that a top portion of the signal terminal is exposed in the receiving space while a bottom portion of the signal terminal extends out of the insulating base and is soldered to a signal contact on a circuit board; the top portion of the signal terminal being provided with a clamping notch such that, once the coaxial cable is properly inserted into the receiving space, a portion of the conductor that is at the end of the coaxial cable is engaged in the clamping notch and is electrically connected to the signal terminal; and a ground terminal set in a bottom portion of the insulating base, wherein the ground terminal has a top portion extended with two first clamping plates and two second clamping plates, the first clamping plates and the second clamping plates extend through the second assembly groove and the third assembly groove respectively and are exposed in the receiving space, the ground terminal has a bottom portion extending out of the insulating base and soldered to a ground contact on the circuit board, the second clamping plates as well as the first clamping plates define a clamping distance therebetween, the clamping distances are smaller than or equal to an outer diameter of the copper braid shield of the coaxial cable in order for the first clamping plates to clamp a portion of the copper braid shield that is adjacent to the end of the coaxial cable and for the second clamping plates to also clamp the copper braid shield, the first clamping plates and the signal terminal define a first distance therebetween, the second clamping plates and the first clamping plates define a second distance therebetween, and the second distance is greater than the first distance.

6. The cable connector of claim 5, wherein the second distance and the first distance are in a ratio of 2~3:1.

7. The cable connector of claim 6, wherein the cable connector further comprises a reinforcing element embedded in the housing at a position adjacent to the through hole.

* * * * *